United States Patent [19]

Hines

[11] 3,987,599

[45] Oct. 26, 1976

[54] WOOD PANELING

[75] Inventor: John H. Hines, Stuttgart, Ark.

[73] Assignee: Potlatch Corporation, San Francisco, Calif.

[22] Filed: June 30, 1975

[21] Appl. No.: 591,335

[52] U.S. Cl. ..... 52/589; 52/595

[51] Int. Cl.[2] ..... E04C 1/30; E04C 2/10

[58] Field of Search ..... 52/233, 589, 590, 591, 52/592, 593, 594, 595

[56] References Cited

UNITED STATES PATENTS

| | | | |
|---|---|---|---|
| 187,502 | 2/1877 | Banker | 52/589 |
| 335,342 | 2/1886 | Daugherty | 52/593 |
| 1,168,583 | 1/1916 | Volz | 52/589 |
| 1,785,499 | 12/1930 | Sayers | 52/589 |
| 2,004,193 | 6/1935 | Cherry | 52/595 |
| 2,665,455 | 1/1954 | Salo | 52/595 |

FOREIGN PATENTS OR APPLICATIONS

| | | | |
|---|---|---|---|
| 1,484,122 | 1/1969 | Germany | 52/592 |

*Primary Examiner*—Price C. Faw, Jr.
*Assistant Examiner*—William Randolph
*Attorney, Agent, or Firm*—Wells, St. John & Roberts

[57] ABSTRACT

A wood paneling product for assembly on a wall. Individual pieces of solid wood are joined end to end and side to side by complementary tongue and groove configurations which provide coplanar wood surfaces between raised finished panel sections. The specific joint configurations insure maintenance of a flat panel and accommodate the normal shrinkage and expansion encountered in wood products. A maximum wood thickness is maintained throughout the panel area to further insure against undesirable warping and bending. The end joints have a minimum tongue thickness which permits the boards to be joined end to end without a backing member being located behind the joints.

3 Claims, 4 Drawing Figures

WOOD PANELING

BACKGROUND OF THE INVENTION

This invention relates to wood paneling that is prefabricated for installation on interior walls. The paneling is made from solid wood and can be installed without special tools or skills. The panel pieces themselves fit to one another to produce a uniform and repeatable pattern. Each piece is joined along its sides and its ends by complementary tongue and groove structures.

From the standpoint of the ultimate user, an important feature of this paneling product is the rich, impressive appearance that the panel provides when properly installed. Installation can be made on exterior or interior walls. The paneling provides all of the handsome features generally expected of expensive set-in paneling so common in expensive homes and offices.

Each piece of material is accented through a joint whereby the individual pieces overlap or interlock, but a visible "gap" appears about its boundaries. A major portion of the panel is slightly elevated beyond the surrounding wood at each joint. Each panel piece is made from a single piece of wood. The attractiveness of the panel is accentuated by beveling of all four edges about the raised portion of the panel.

SUMMARY OF THE INVENTION

The wood paneling product comprises individual longitudinal wood panel pieces of solid wood. Each panel piece has a face surface and a parallel back surface. The face surface is bounded at opposite sides and opposite ends by finished side and end surfaces of equal thickness. The longitudinal groove runs along the length of each panel piece at one side, with a complementary longitudinal tongue running along its remaining side. The groove is formed by planar side walls, one side wall intersecting the finished side surface of the panel. The tongue is formed of planar sides, one side intersecting the adjacent finished side surface of the panel. A portion of this planar side is exposed after the panel piece is installed, and serves as the "gap" between adjacent side by side panel pieces. The ends of the paneling are formed in a similar manner, but with a tongue and groove configuration of substantially less thickness than along the sides. A small shoulder is provided in the side grooves to accommodate expansion of the wood without causing the paneling to deviate from its desired plane condition.

It is an object of this invention to provide a factory finished solid wood panel that can be installed readily and relatively inexpensively. Installation of the panel does not require nailers or other supports behind the end-match joints. The end-matches can be located at a random fashion wherever they occur or can be accurately aligned where desired.

Another object of the invention is to provide a unique panel which provides a "gap" at both the side and end joints, but does not give any appearance of visible joints throughout the panel structure.

Another object is to provide a panel product, when properly installed, which maintains a virtually waterproof joint for siding, with either horizontal or vertical placement.

These and further objects will be evident from the following disclosure and the accompanying drawings, which illustrate a preferred form of the invention.

DESCRIPTION OF A PREFERRED EMBODIMENT

Figure 1:
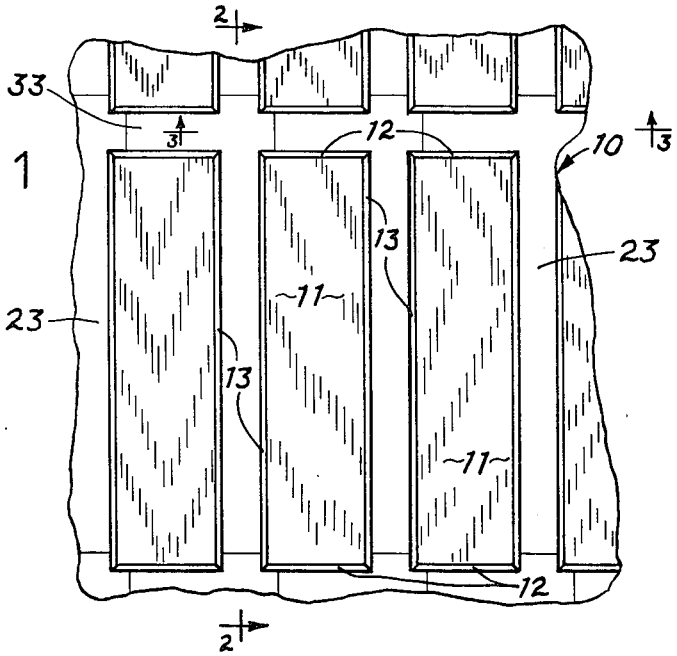
FIG. 1 is a fragmentary plan view of the paneling installed on a wall surface.

This relates to wood paneling products designed for finishing interior or exterior walls. The paneling product can be made from hard woods or soft woods and can be finished in a smooth or rustic appearance. The finished paneling, when installed on a wall as shown in FIG. 1, has the appearance of a random number of raised boards separated from one another by a wood gap. When installed as shown in FIG. 1, it has the appearance of a very rich and formal wall configuration otherwise achieved by panel methods that require substantial skill and expense. If desired, the joints can also be placed randomly along the length of the boards and offset in a random pattern.

Figure 4:
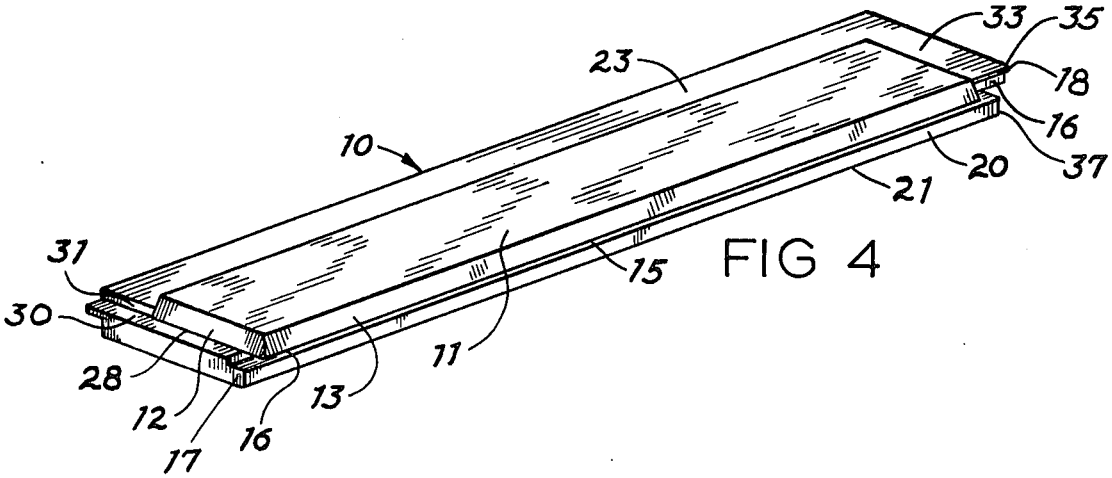
FIG. 4 is a perspective view of a single panel piece.

The panel piece shown in FIG. 4 is the basic material from which the paneled wall is formed. Each panel piece 10 includes a finished face 11, which is planar and can be finished as a smooth surface or as a roughened rustic surface. Each face 11 is surrounded by beveled end surfaces 12 and beveled side surfaces 13 at their respective ends and sides. Surfaces 12, 13 are exposed and finished.

Figure 3:
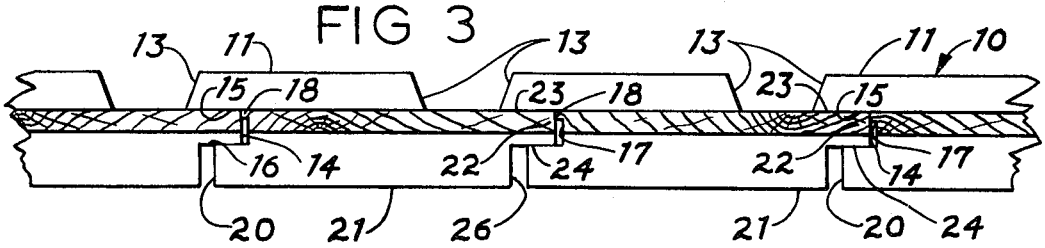
FIG. 3 is an enlarged fragmentary transverse sectional view taken along line 3—3 in FIG. 1.

A longitudinal groove 14 is formed along a first side of each panel piece (FIG. 3), and is complementary to a longitudinal tongue 22 formed along its remaining side. Each groove 14 has an outer side wall 15 and a spaced parallel inner side wall 16. The side walls 15, 16 are planar and located along planes parallel to face 11. They terminate at a bottom wall 17 perpendicular to the plane of face 11. The inner side wall 16 is spaced also from the back surface 21 of the panel. In the illustration shown in the drawings, the longitudinal grooves 14 have a total thickness of approximately ⅓ the thickness through the complete panel piece 10. For ¾ inch stock, the thickness of the groove 14 would be approximately ¼ inch.

A longitudinal shoulder 18 is formed within the longitudinal groove 14 along one corner between the side wall 15 and the bottom wall 17. The shoulder 18 serves to position the tongue 22 within the groove and is relatively small in relation to the groove and tongue dimensions. Its relative size permits the shoulder 18 to collapse slightly if required by expansion of the wood.

The outer side wall 15 intersects the adjacent finished side surface 13 and defines the thickness of the side surface 13 by such intersection. The opposite side wall 16 is terminated along a longitudinal abutment 20 perpendicular to the plane of face 11. The abutment 20 extends to the groove 14 at a location inward from the intersection of side wall 15 and beveled side surface 13. Thus, the finished visible portion of the panel overlaps the groove 14 and abutment 20 which are not visible in the installed paneling.

The longitudinal tongue 22 is complementary to the groove 14. It is formed with a planar outer side 23 and spaced planar inner side 24, both being parallel to the plane of the face 11. The outer side 23 of the tongue 22 is finished and is coplanar with the side wall 15 described in relation to the structure of groove 14. It intersects the adjacent finished side surface 13 to define the thickness thereof. The remaining side 24 of the longitudinal tongue 22 is substantially coplanar with inner side wall 16 of groove 14. It terminates along a shoulder 26 that leads to the tongue 22 from back surface 21 at a location outward from the intersection of side surface 13 and the outer side 23 of the longitudinal tongue 22. The lateral dimension of side 24 is greater than the lateral dimension of side wall 16 formed within groove 14. This provides spacing between the adjacent back surfaces 21 of each panel piece when the tongue 22 is fully received within groove 14.

When assembled, the face 11, the beveled end and side surfaces 12, 13 and a substantial portion of the outer side 23 of each tongue 22 are all exposed to exterior view. A substantial thickness of wood lies behind the exposed portion of the side 23. The substantial thickness behind the "gap" between the adjacent panel pieces minimizes warping or other distortion of the boards where they are joined. The extended tongue also permits nailing of the boards through the tongue 22 at an angle such that approximately ⅔ of the board can be nailed without exposing the nail head in the completed panel.

The end joint is quite similar to that of the side joint, but is substantially less in thickness. Where the side joint has a tongue and groove thickness of about ⅓ the total thickness of the panel piece, only about 1/6 of that total thickness is required at the end joint. This greatly increases the total average thickness of the panel piece at the end joints and provides a heavy interconnection which eliminates the need for any mechanical backing rearward of the joint. This is particularly of importance in installations where random end joints are utilized.

Figure 2:
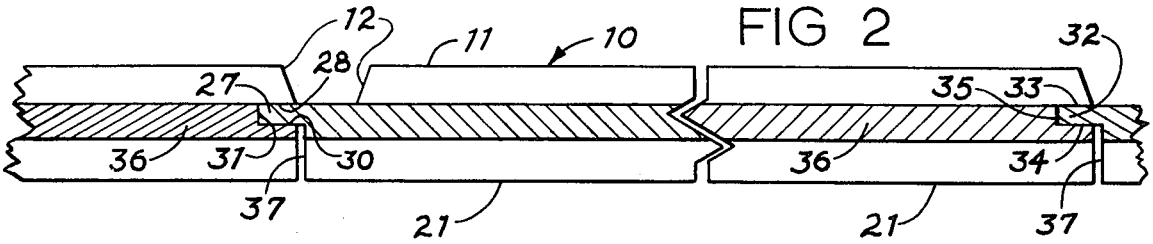
FIG. 2 is an enlarged fragmentary sectional view taken along line 2—2 in FIG. 1.

Each end joint includes a transverse groove 27 and complementary transverse tongue 32 (FIG. 2). The transverse groove 27 includes an outer side wall 28 and an inner side wall 30. They lead to a bottom wall 31 at the base of each groove. The groove terminates along a shoulder 36 at a location under the adjacent beveled end surface 12. No inner shoulder is required in the transverse groove.

The tongue 32 includes an outer side 33 which is finished as described above with respect to tongue 22. It also includes an inner side 34 and a terminal or outer wall 35. A shoulder 37 leads to the back surface 21 at a location outward from the adjacent beveled end surface 12. The outer side 33 is coplanar with the side 23 of the longitudinal tongue 22 and the respective sides 23, 33 are finished as a unit to bound two sides of face 11 in conjunction with similar surfaces provided by adjacent panel pieces. The panel structure is believed to be clear from the drawings.

The joint configuration at both the sides and ends of each panel piece 10 provides maximum assurance that the panel pieces will remain flat when installed and will not develop open joints despite all of the normal moisture content changes that take place within the wood. The end and side joints are designed so that a carpenter or cabinet maker can attach the panels to a wall without special skill or tools. Once a first row of panel pieces have been installed the remainder of the wall can be positioned without measuring and without the use of a plumb line.

The side grooves have a small shoulder 18 which provides a small bearing area so that the pieces will fit snugly against each other. The actual bearing area is so small that should expansion occur, it can be absorbed without visible damage or modification at the surface of the paneled wall. The shoulders 18 within the longitudinal grooves 14 provide adequate contact for aligning the panels and absorb whatever compression might take place after installation. In ¾ inch hardwood panels, the shoulder 18 has been designed to have a dimension of 1/16 by 1/16 inches. This design size was selected to accommodate the anticipated maximum expansion that would be encountered by the material while in service. The normally anticipated moisture content change would be a maximum of four percent moisture content. Within this range, even woods with the greatest tendency to expand would expand only about 3/32 of an inch in an 8 inch wide panel.

It is well recognized that wood is most weak across the grain. The joint in this panel product has therefore been designed so that the maximum possible thickness in the tongue 22 in the side joint is maintained. The thin interlocking portion of the tongue is preferably extended only a minimum distance required for insertion within groove 14. The extension of the panel piece that supports the "gap" along the applied panel is much more thick than the projecting tongue itself, which strengthens the projection of the tongue 22 and provides adequate strength for both the tongue and the "gap."

The end joint is also designed to provide for some expansion of the panel. However, since the endwise expansion of wood is substantially less than the cross grain expansion, the different configuration of the tongue 32 and groove 27 is permissable. In fact, in wood design, endwise expansion is often considered to be negligible. Wood also has much greater strength along the grain and therefore the tongue 32 at the end of each panel piece 10 can be relatively thin. The small bearing area provided at the end of the tongue on the bottom of the groove and the relatively small amount of dimensional change in the lengthwise direction of the panel piece 10 in response to moisture change provides a joint capable of absorbing any expansion that might take place by compression of the tongue and the bottom of the groove. Both the tongue 22 and tongue 32 are of course long enough that the small amount of shrinkage that may occur upon drying of the panel would never expose an open joint.

Another reason for the differing joint configuration between the side joints and the end joints relates to the machining characteristics of wood. Wood machines readily along the grain but is more difficult to machine across the grain. It is therefore relatively easy to provide a small square shoulder 18 at the bottom of groove 14 running longitudinally along the grain of the wood. Machining across the end of the panel piece is much more difficult and therefore dictates a more simple tongue and groove configuration.

While the back surface 21 of panel piece 10 has been illustrated as being planar, conventional grooves or other such configurations can be used to help maintain the panel in a flat condition on the wall.

The wood paneling product is defined in the claims that follow this detailed description.

Having thus described my invention, I claim:

1. A wood paneling product comprising:

individual longitudinal panel pieces of solid wood adapted to be joined end to end and side to side to form a parallel wall surface;

each panel piece having a face bounded at opposite sides and opposite ends by finished side and end surfaces having equal thickness in a dimension perpendicular to the face, the thickness of the finished side and end surfaces being less than the total thickness of the panel piece;

a longitudinal groove running uninterrupted along the length of each panel piece at one side thereof, the longitudinal groove having planar side walls parallel to one another and to the face surface, one side wall of the longitudinal groove intersecting the adjacent finished side surface bounding the face of the panel piece and defining the thickness thereof, the remaining side wall of the longitudinal groove being parallel to and spaced inwardly from the back surface of the panel piece and extending inward to the bottom of the groove, the back surface of the panel piece being terminated along a longitudinal abutment extending inward to the longitudinal groove at a location inward from the intersection of the one side wall of the longitudinal groove and the adjacent finished side surface of the panel piece;

and a longitudinal tongue running uninterrupted along the length of each panel piece at the remaining side thereof, the longitudinal tongue having planar sides parallel to one another and to the face surface one side of the longitudinal tongue being coplanar with the one side wall of the longitudinal groove and intersecting the adjacent finished side surface to define the thickness thereof, the remaining side of the longitudinal tongue being substantially coplanar with the remaining side wall of the longitudinal groove, the back surface of the panel piece forming a shoulder leading to the tongue at a location outward from the intersection of the one side of the longitudinal tongue and the adjacent finished side surface of the panel piece;

said longitudinal groove having a bottom wall perpendicular to the side walls thereof;

said longitudinal tongue having an outer wall perpendicular to the sides thereof;

the effective depth of the longitudinal groove being less than the effective depth of the longitudinal tongue, whereby the respective face of each panel piece, when assembled within a parallel wall surface, will be spaced to the side of one another;

a small longitudinal shoulder being formed between one side wall of the longitudinal groove and the bottom wall thereof and extending across only a small fraction of the longitudinal groove so as to be capable of yielding when required by expansion of adjacent panel pieces.

2. A wood paneling product as set out in claim 1 wherein the finished side and end surfaces of the panel pieces are beveled and flare outward from the face thereof.

3. A wood paneling product comprising:

individual longitudinal panel pieces of solid wood adapted to be joined end to end and side to side to form a parallel wall surface;

each panel piece having a face bounded at opposite sides and opposite ends by finished side and end surfaces having equal thickness in a dimension perpendicular to the face, the thickness of the finished side and end surfaces being less than the total thickness of the panel piece;

a longitudinal groove running uninterrupted along the length of each panel piece at one side thereof, the longitudinal groove having planar side walls parallel to one another and to the face surface, one side wall of the longitudinal groove intersecting the adjacent finished side surface bounding the face of the panel piece and defining the thickness thereof, the remaining side wall of the longitudinal groove being parallel to and spaced inwardly from the back surface of the panel piece and extending inward to the bottom of the groove, the back surface of the panel piece being terminated along a longitudinal abutment extending inward to the longitudinal groove at a location inward from the intersection of the one side wall of the longitudinal groove and the adjacent finished side surface of the panel piece;

and a longitudinal tongue running uninterrupted along the length of each panel piece at the remaining side thereof, the longitudinal tongue having planar sides parallel to one another and to the face surface one side of the longitudinal tongue being coplanar with the one side wall of the longitudinal groove and intersecting the adjacent finished side surface to define the thickness thereof, the remaining side of the longitudinal tongue being substantially coplanar with the remaining side wall of the longitudinal groove, the back surface of the panel piece forming a shoulder leading to the tongue at a location outward from the intersection of the one side of the longitudinal tongue and the adjacent finished side surface of the panel piece;

a transverse groove formed across the width of each panel piece at one end thereof, the transverse groove having planar side walls parallel to one another and to the face surface; one side wall of the transverse groove being coplanar with the one side wall of the longitudinal groove, the one side wall of the transverse groove intersecting the adjacent finished end surface bounding the face of the panel piece and defining the thickness thereof, the remaining side of the transverse tongue being parallel to and spaced inwardly from the back surface of the panel piece, the back surface of the panel piece being terminated along a transverse shoulder extending inward to the transverse tongue at a location outward from the intersection of the one side of the transverse tongue and the adjacent finished end surface of the panel piece;

the distance separating the sides of the longitudinal tongue being substantially greater than the distance separating the sides of the transverse tongue.

* * * * *